US005899396A

United States Patent [19]

Nied

[11] Patent Number: 5,899,396

[45] Date of Patent: May 4, 1999

[54] AIR SEPARATOR AND SINGLE-ROTOR AIR SEPARATOR MILL WITH SUCH AN AIR SEPARATOR

[76] Inventor: Roland Nied, Raiffeisen-Strasse 10, 86486 Bonstetten, Germany

[21] Appl. No.: 08/701,161

[22] Filed: Aug. 21, 1996

[30] Foreign Application Priority Data

Sep. 4, 1995 [DE] Germany ..... 195 32 555
Sep. 25, 1995 [DE] Germany ..... 195 32 524

[51] Int. Cl.[6] ..... B02C 13/288

[52] U.S. Cl. ..... 241/79.1; 241/188.1

[58] Field of Search ..... 209/154; 241/79.1, 241/188.1, 188.2, 189.1, 57

[56] References Cited

U.S. PATENT DOCUMENTS 3,395,796 8/1968 Ruegg ..... 209/154
4,626,343 12/1986 Folsberg ..... 241/79.1
4,689,141 8/1987 Folsberg ..... 241/79.1
5,190,227 3/1993 Pallmann ..... 241/79.1
5,622,321 4/1997 Brundiek et al. ..... 241/79.1

*Primary Examiner*—Mark Rosenbaum
*Attorney, Agent, or Firm*—Levine & Mandelbaum

[57] ABSTRACT

An air separator for crushing coarse particles of a material and separating resultant fine particles has a single motor which drives a separator wheel having a plurality of blades mounted between two disks and defining radial blade channels through which separating air carries the fine particles from outside to inside. A plurality of beaters is mounted on one of the disks for crushing coarse particles. Apparatus for continuously varying the cross section of the flow path of the separator air is provided for varying a cut point below which particles are carried by the separating air and above which particles are returned to the beaters for further crushing without variation of the speed of the motor.

16 Claims, 2 Drawing Sheets

AIR SEPARATOR AND SINGLE-ROTOR AIR SEPARATOR MILL WITH SUCH AN AIR SEPARATOR

BACKGROUND OF THE INVENTION

Ground stock generally has various grain sizes at the end of the grinding process and requires classification or separation. The mill and the separator are consequently integrated, in general, into one functional unit. The starting product is charged into the mill, and at the end of the grinding process, the ground stock, freed from coarse particles, reaches the separator, where the coarser and finer components of the ground stock (which have a heavier and lighter weight, respectively), are separated from one another.

The grinder and the separator are subject to different working conditions, which can be readily taken into account or can be readily created if the grinder and the separator are mutually independent units.

If the separator is an air separator, the essential criterion for the separator is the distribution number (the cut point) $d_T$, which is described by the following equation.

$$d_T = \sqrt{18\eta \frac{V_r}{V_u^2} r \frac{1}{\rho}}$$

Here, $d_T$ is the distribution number (the cut point) or the particle size, $\rho$ is the density in $kg/m^3$, $V_r$ is the radial velocity in the separator wheel in m/sec, $V_u$ is the circumferential velocity in the separator wheel in m/sec, r is the radius in m, and n is the dynamic viscosity in $Ns/m^2$.

It follows from this that the distribution number in the separator depends mainly on two velocity components, which in turn means that the speed of the separator wheel must be variable if the working range of the separator is not to be so small that the separator operation would be uneconomical.

This analogously applies to the mill as well. In the case of a beater mill with beaters on the circumference of a rotating disk, the speed of this disk must be variable if the beater mill is to be operated economically.

The lack of a fixed relationship between the speeds of the mill and the separator is an important aspect for the design of a beater mill and an air separator. The speeds of the separator and the mill must be able to be determined and varied independently from one another. This does not represent any special problem if the separator and the mill are mutually independent devices with mutually independent drives.

Problems arise from the above-described situation if the mill and the separator are to be connected to one another not only functionally, but also structurally in order to reduce the cost of construction, or in order to quite simply keep the space required for installation small. It is logical in such a case to provide a common drive motor for the two devices and to provide a torque split transmission between the motor and the mill, on the one hand, and the separator, on the other hand, and to now provide a speed control between the torque split transmission and the mill, on the one hand, and the torque split transmission and the separator, on the other hand. However, this makes the entire machine with the mill and the separator so expensive that other advantages, which are expected from the structural integration, would be offset. Separate drives for the separator and the mill with speed controls of their own have therefore been maintained to date in practice even in the case of the structural integration of the mill and the separator.

SUMMARY OF THE INVENTION

The present invention is based on the desire to solve the problem in a more expedient manner. The object of the present invention is consequently to show, based on an air separator mill, a possibility of how a beater mill and a separator can be integrated into a common device with only one drive, but the mill and the separator can yet be controlled independently from one another at a reasonable expense. This object is accomplished on the basis of the mathematical equation described above.

Based on the problem of an air separator mill, which was discussed above, the underlying problem of the present invention can be defined in a general manner as follows.

The distribution number as an essential criterion of an air separator depends essentially on the speed of the separator wheel. The controllability of the speed of the separator wheel is therefore a prerequisite for the economical use of the separator wheel. However, cases are conceivable in which it is not readily possible to set the speed of the separator wheel such that a desired distribution number will be reached in an optimal manner. The object of the present invention is consequently to design an air separator such that the distribution number can be varied or an optimal distribution number can be reached as an alternative or in addition to the variation of the distribution number by varying the speed of the separator wheel. "Distribution number" means the "determination of the cut point" in this connection, i.e., the extent to which coarser material is rejected by the separator wheel under the effect of the centrifugal force and finer material leaves the separator wheel via the central fine material outlet together with the separating air under the action of the centrifugal force. This shall also be based on the mathematical equation described above.

This object is accomplished as described in the patent claims, concerning the general part with the air separator alone and the more special part pertaining to an air separator mill.

Thus, the present invention points toward two solution variants for the practical embodiment, and both of them are based on the mathematical equation described.

The overall height of the separation space of an air separator is adjustable according to one solution, and the fine material outlet of the separator is designed as an adjustable diaphragm according to the other solution. As is shown by the following description of two embodiments, which are shown in one of the two figures of the drawings each, both solution possibilities according to the present invention can be embodied at a relatively low cost of construction. Both cases are based on a unit formed by the mill and the separator, in which the motor power take-off is variable in view of the necessary speed of the mill, and the separator is also driven at that speed, but the working conditions of the separator can nevertheless be varied independently from the mill. The description is considered to be clear to the person skilled in the art even if only an air separator alone is concerned, whose distribution number shall be variable despite a constant speed.

DESCRIPTION OF THE PREFERRED EMBODIMENT

Figure 1:
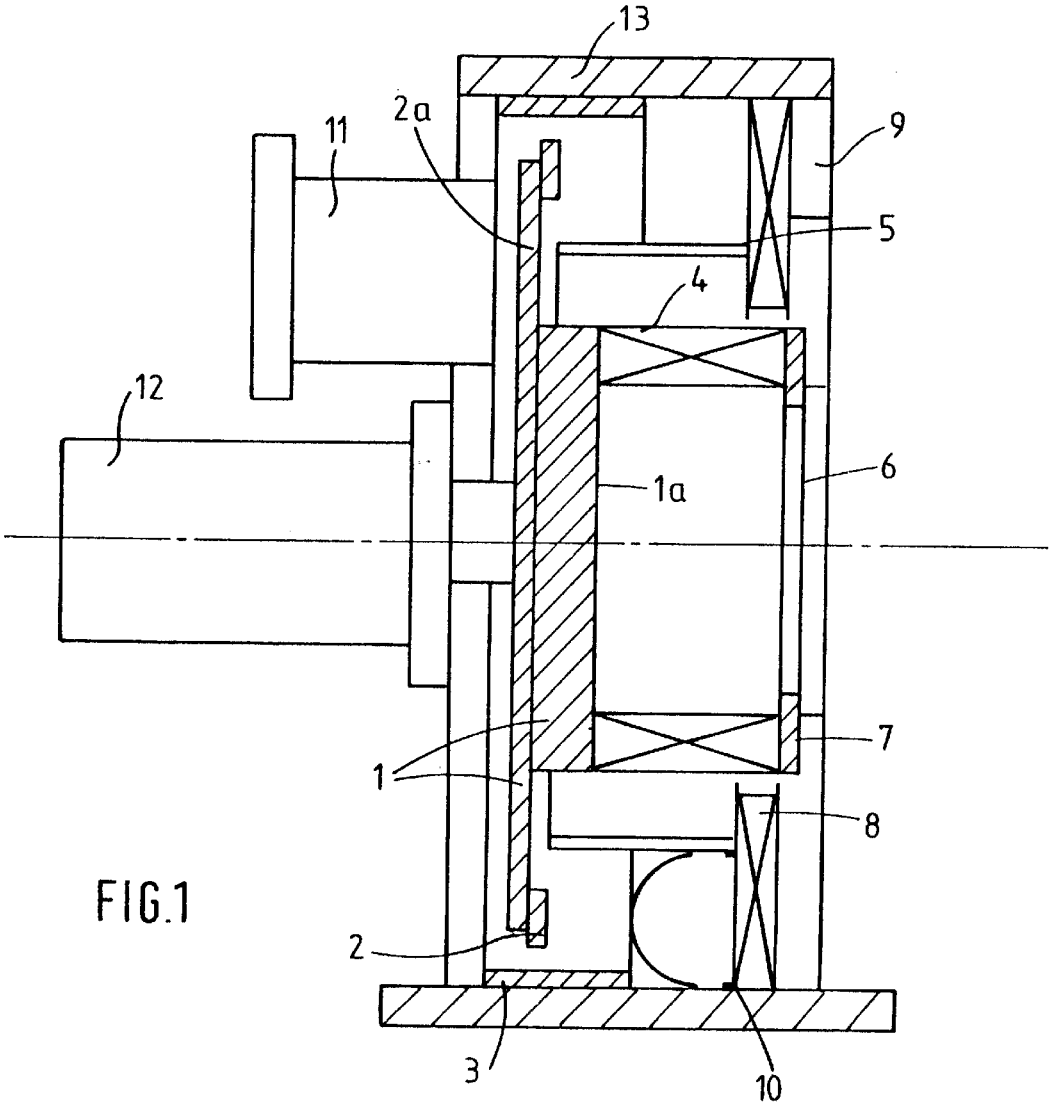
FIG. 1 shows a central longitudinal section of a single-rotor air separator mill, in which one of the two cover disks of the separator according to the present invention is designed as an adjustable diaphragm, or this one of the two cover disks, namely, the fine material outlet-side cover disk, has such a diaphragm.

The single-rotor air separator mill according to FIG. 1 has in the known manner the rotor 1, which includes a disk 2*a* with beaters 2 on its outer circumference, as well as one cover disk 1*a* of the separator with the separator blades 4 rigidly connected to it. The beaters cooperate with a material path 3 on the inside of the housing of the device. The ground stock crushed due to the cooperation between the beaters 2, on the one hand, and the grinding path 3, on the other hand, is discharged radially from the outside together with the separating air into the channels between the separator blades 4, the cover disk 1*a*, as well as the second, outlet-side cover disk 7 of the separator, where the separation into coarse material and fine material takes place. The fine material, i.e., the ground stock with a relatively low weight, is entrained by the separating air against the action of the centrifugal force radially from the outside to the inside, through the separator wheel, i.e., its blade channels between the separating blades 4 and the cover disks 1*a*, 7, in order to leave the air separator mill through the central fine material outlet 6, which is surrounded by the second cover disk 7, and to be subjected to the further treatment, which is usually the separation into fine material and separating air in a filter. The coarse material, i.e., the ground stock of a relatively heavy weight, is rejected in the separator wheel under the action of the centrifugal force, it returns into the range of action of beaters 2 and the grinding path 3, and it is thus returned repeatedly until particles of a relatively low weight are formed, which are removed from the air separator mill in the above-described manner.

Other essential components of the air separator mill are the guide blades 8, a housing 13 with a housing opening, which is closed by a door 9 during the operation, the pneumatic product inlet 10, the separating air inlet 11, and the drive motor 12.

If the rotor 1 is set to rotate by means of the motor 12 in the stationary housing 13 of the air separator mill with the door 9 closed, the starting product enters the range of action of the beaters 2 through the product inlet 10, the starting product is separated into coarse material and fine material, and the coarse material and the fine material are treated in the above-described manner.

Thus, the design and the mode of operation of the presumed beater mill are definitely usual, so that this does not need to be discussed in greater detail.

The mode of operation of the beaters with respect to the product depends on the speed of the parts of the mill with the disk 2*a* and the beaters fastened thereto. This speed depends on the speed of the motor 12, and a change in the speed of the mill can be brought about by changing the speed of the motor itself, or, at constant speed of the motor, by means of a reducing and/or stepup transmission. The speed of the separator wheel with the cover disk 1*a*, which is directly connected to the disk 2*a*, with the separating blades 4, and with the cover disk 7 is also determined, and changed if necessary, with the speed of the mill. To make it now possible to change the distribution number of the separator despite this dependence, the cover disk 7 is designed as a prior-art iris diaphragm. The outlet cross section 6 can be varied by adjusting the diaphragm, and the iris diaphragm is a preferred means of determining the circumferential velocity of the fine material such that an optimal distribution number of the separator is possible, taking into account the formula presented in the introduction, regardless of the determined or selected speed of the mill, which is to guarantee optimal operation of the mill.

Figure 2:
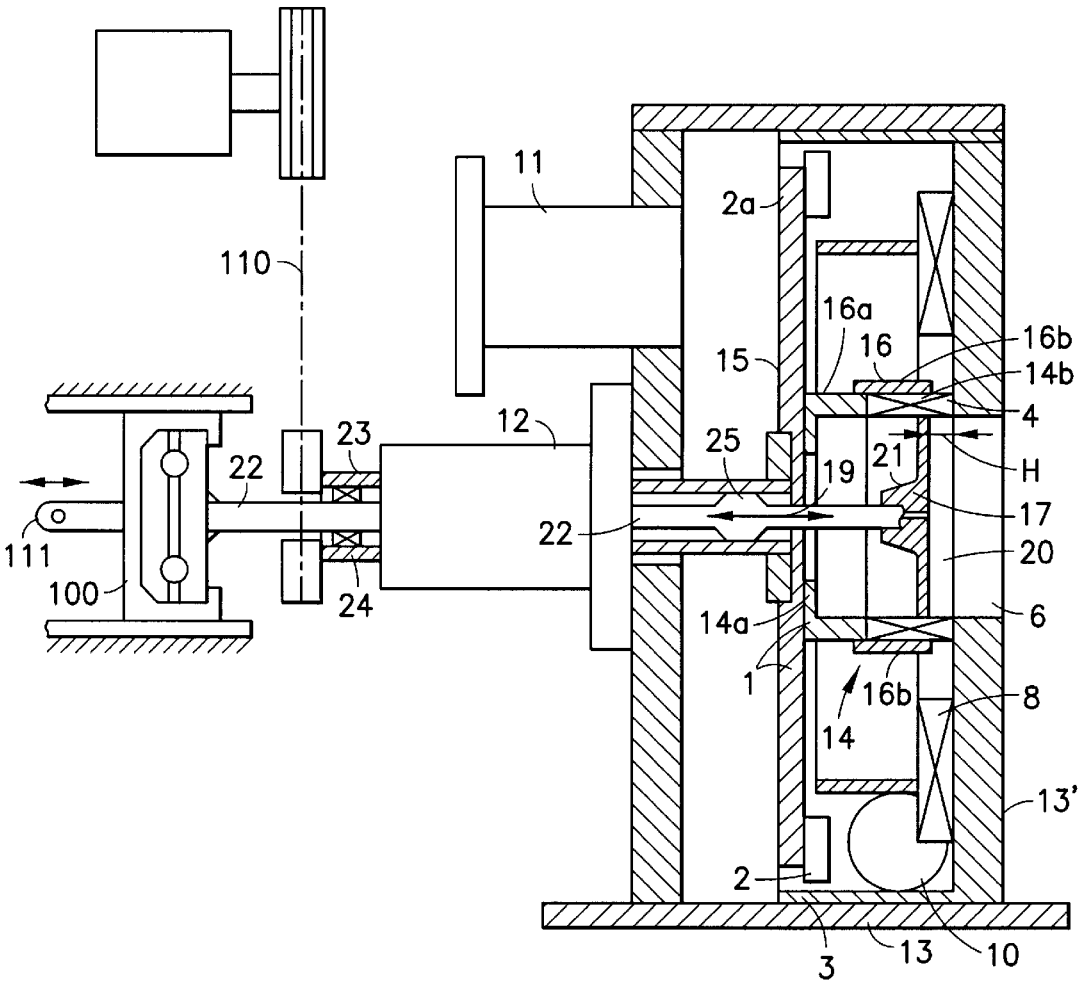
FIG. 2 shows an identical mode of representation of an air separator mill, in which the only cover disk of the separator is adjustable in height in order to make it possible to change the overall height of the separation space by adjusting this one cover disk.

The air separator mill according to FIG. 2 is identical to a mill and separator in terms of its basic design and its mode of operation. The mill is in turn formed essentially by the rotor 1 with the mill disk 2*a* and the beaters 2 fastened to it, while the separator or the separator wheel is characterized essentially by a telescopically longitudinally adjustable cylinder 14 with a bottom 15, a cylinder wall 16, an outlet-side, adjustable cover disk 17, as well as the separator blades 4. One part 14*a* of the cylinder 14 with the bottom 15, which is connected to the disk 2*a*, and with the inner cylinder wall section 16a carries the blades 4 of the separating blade ring at the free end of the cylinder wall section 16*a*. The other part 14*b* of the cylinder 14 extends with the free end of the outer cylinder wall section 16*b* telescopically in the direction of the double arrow 19, continuously adjustably over the inner cylinder wall section 16*a*, and it defines with the cover disk 17 the separating chamber 20 between the cover disk 17 of the housing wall 13' with the fine material outlet 6 arranged centrally in relation to the separator wheel and the free parts or sections of the blades 4, i.e., the parts or sections not covered by the outer cylinder wall section 16*b*. The overall height H of the separating chamber 20 is adjustable by adjusting the cover disk 17 as part of the other part 14*b* of the cylinder 14. The blades 4 shall be led through slots in the cover disk 17 in such a way that they do not hinder the adjusting movements of the cover disk 17, but possibly in a fluid-tight manner, and an abrasion-resistant sliding seal is located between the parts 16*a*, 16*b*. The parts 16*a*, 16*b* consequently form an annular diaphragm surrounding the blades with two annular diaphragm sections telescopically adjustable against each other.

While the free cross section of the fine material outlet 6 is variable in the embodiment of the separator according to FIG. 1 by adjusting the iris diaphragm, and it is thus possible to change the velocity of the circumferential flow, the cross section of the fine material outlet 6 surrounded by the housing wall 13' is constant in the embodiment according to FIG. 2, but the cover disk 17 is axially adjustable, and the overall height of the air separator and consequently the velocity of the radial circumferential flow are variable in order to be able to again optimize the mode of operation of the mill and the mode of operation of the separator in a functionally mutually coordinated manner, but without any restriction by any structural dependences.

The cover disk 17 of the cylinder part 14*b* has a hub 21, with which the cylinder part 14*b* is arranged on a shaft 22 adapted to rotate in unison. The telescopic adjustability of the cylinder part 14*b* and consequently of the cover disk 17 is brought about by the fact that the shaft 22 is connected to the output shaft 23 of the motor 12 in such a way that it is adapted to rotate in unison with it, but it is axially displaceable in relation to the output shaft 23 by the two shafts being connected to one another by, e.g., a prior-art keyway coupling 24. One of the two shafts is designed as a tubular shaft with longitudinal grooves in the inner wall or longitudinal ribs on the inner wall, and the other of the two shafts is designed as a solid shaft with corresponding longitudinal keys on the outer wall or with longitudinal grooves in the outer wall. The axial displaceability of the shaft designed as a solid shaft in relation to the motor power take-off shaft designed as a hollow shaft is indicated by the double arrow 19. The motor power take-off shaft may be directly the shaft led out of the motor 12; it may be connected to the motor power take-off shaft via a transmission, or it may be connected to the shaft led out of the motor via other suitable and prior-art means, e.g., a belt drive. Reference number 25 designates a slideway between the two shafts 22, 23 in their smooth sections.

The drive power of the motor 12 is introduced in this case once into the rotor 1, into the cylinder or into the annular diaphragm 14 formed by it, into the separator wheel blades 4, and into the cover disk 17 via the motor output shaft 23, and once directly into the cover disk 17 via the shaft 22. However, it is also possible to abandon the keyway coupling 24 in favor of another slideway (corresponding to 25), so that the shaft 22 is driven via the cover disk 17 driven by the shaft 23, namely, when the connection between the hub 21 and the shaft 22 is a connection adapted to rotate in unison, or the shaft is only axially adjustable when the keyway coupling 24 is abandoned in favor of another guide bearing (corresponding to the slideway in the form of the collar 25) and the rotatability in unison of the connection between the hub 21 and the shaft 22 is abandoned; it is only to be ensured in this case that the shaft 22 carries the cover disk 17 during axial displacements of the shaft 22 in the directions indicated by the double arrow 19.

The separator wheel is rotatably mounted in the housing 13. A belt drive 110 is operatively connected to the power takeoff shaft 23, the driven shaft 22 projecting axially therefrom behind the belt drive 110. The axially driven shaft 22 is connected to an adjusting lever 111 which is in turn fastened to the housing via a thrust bearing 100. Identical reference numbers are used if the parts in the two embodiments are identical, so that more detailed references may be omitted.

Figure 1A:
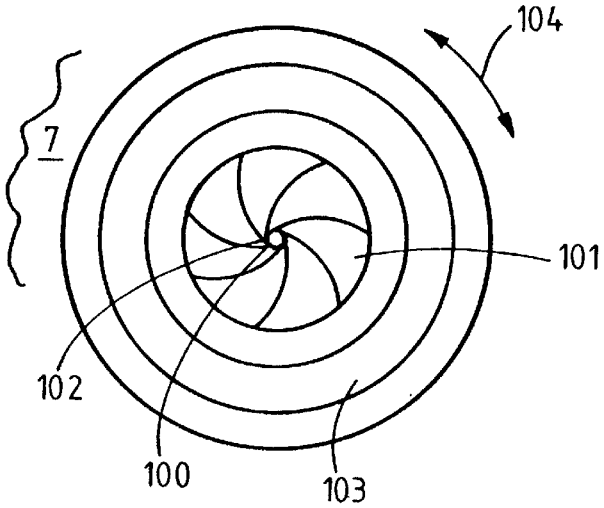
FIG. 1*a* shows a detail of the arrangement according to FIG. 1.

Even though the iris diaphragm in the cover disk 7 in the embodiment according to FIG. 1 is a prior-art assembly unit, such a diaphragm is schematically shown on a larger scale in the partial FIG. 1*a*, viewed in the direction of the separating air flow which is leaving the separator and is loaded with fine material. This is an apertured diaphragm with variable cross section, wherein this variation of the cross section of the hole 100 is possible due to the fact that between about 6 and about 30 crescent-shaped lamellae 101 are parts of the circumference of the hole 100 with their ends 102 and are associated at their other ends with a continuously adjustable adjusting ring 103, which is mounted rotatably in the direction of the double arrow 104 in the cover disk 7 proper. By rotating the adjusting ring 103 in the cover disk 7 in one of the two directions of the double arrow 104 or the other, the lamellae 101 are pivotable such that the cross section of the hole 100 becomes larger or smaller, and the outlet cross section of the fine material outlet 6 is varied correspondingly. The adjusting ring 103 is rotated from the outside by prior-art means, e.g., by a motor operator or a simple rod assembly to be actuated manually.

A guide ring, which cooperates with the guide blades 8, is designated by 5 in both cases (FIGS. 1 and 2). The separating air entering via the separating air inlet 11 enters the guide blade ring 8 in the annular space between the guide ring 5 and the housing wall and is deflected there into a corresponding counter-flow between the guide ring 5 and the separator wheel in order to enter the flow channels between the blades of the separator wheel from the outside with the material to be separated, which was introduced via the inlet 10 for material to be separated, and the separation into fine material and coarse material takes place in the flow channels. The separating air with fine material leaves the separator via the outlet 6, the coarse material is rejected in the inlet area of the flow channels between the blades of the separator wheel by the centrifugal force and it is brought into the range of action of the mill through the annular space between the guide ring 5 and the separator wheel.

The structural association of the cover disk 7 enclosing the diaphragm with the separator wheel is assumed in the embodiment according to the top part of FIG. 1. It should be pointed out that this cover disk 7 with the adjustable diaphragm may also be separated from the separator wheel and be associated with the housing 13, especially the cover 9. This solution may be advantageous because the cover disk 7 with the diaphragm may have a heavier weight compared with simpler cover disks, and no additional drive energy is necessary for this heavier weight if the cover disk is separated from the separator wheel and is associated with the housing.

In summary, the present invention can be defined in that two preferred solutions are shown for the problem of varying the cut point of the separator in an air separator during phases of operation at constant speed of the separator wheel.

What is claimed is:

1. In an air separator for crushing a material having coarse particles to form fine particles and separating the fine particles from the coarse particles, said separator having a housing, a single motor mounted on said housing, a cylindrical separator wheel connected to said motor for being driven thereby, said separator wheel comprising a first cover disk, a second cover disk axially displaced from said first cover disk, and a plurality of blades mounted between said first and second cover disks and defining radial blade channels therebetween, and an outlet to which fine particles are carried by separating air which flows from the outside of said separating wheel to the inside of said separating wheel against centrifugal force in order to cause separation of a material into coarse and fine particles, the outlet for the separating air loaded with fine particles being arranged concentrically to the separator wheel, and the separator wheel being driven via said first cover disk, the improvement wherein said first cover disk comprises a plurality of beaters mounted thereon adjacent the circumference thereof for crushing coarse particles of said material into fine particles, whereby crushing and separating are accomplished by said single motor, and means mounted on one of said housing and separator wheel in the flow path of the separator air for continuously varying the cross section of the flow path of the separator air whereby a cut point of the separator can be varied while the speed of the separator wheel remains constant.

2. An air separator in accordance with claim 1, wherein the second cover disk has an outlet for the fine particles, and further comprising means mounted on said second cover disk for continuously varying the cross section of said outlet.

3. An air separator in accordance with claim 2, further comprising driving means connected to said first cover disk for causing rotation thereof.

4. An air separator in accordance with claim 3, wherein the fine particles outlet comprises a diaphragm having a continuously variable cross section.

5. An air separator in accordance with claim 4, wherein the diaphragm is an iris diaphragm, and said second cover disk has an interior surface facing toward said first cover disk and an exterior surface facing away from said first cover disk, and further comprising adjustment means mounted on said second cover disc exterior surface for adjusting the cross section of the fine particles discharge opening.

6. An air separator in accordance with claim 1 further comprising means for continuously varying the sum of the cross sections of the flow channels between the blades.

7. An air separator in accordance with claim 6, further comprising means for varying the axial length of the separator wheel in order to vary the cross sections of the flow channels between the blades.

8. An air separator in accordance with claim 7, further comprising an axially displaceable rod connected to one of said cover disks and extending from the separator wheel for varying the axial length of the separator wheel.

9. An air separator in accordance with claim 8, wherein said rod comprises a driven shaft operatively connected to and rotatably driven by said drive means, said driven shaft being rotatable in unison with said one of said cover disks.

10. An air separator in accordance with claim 9 further comprising a housing, said separator wheel being rotatably mounted in said housing, belt drive means operatively connected to the power takeoff shaft, the driven shaft projecting axially therefrom behind the belt drive means, and an adjusting lever and thrust bearing, the axially driven shaft being connected to the adjusting lever which is in turn fastened to the housing via the thrust bearing.

11. An air separator in accordance with claim 9, wherein said drive means comprises a power takeoff shaft connected to the driven shaft by a keyway coupling, said power takeoff shaft and driven shaft being rotatably fixed but axially displaceable with respect to one another, said power take-off shaft being tubular and said driven shaft being received therewithin.

12. An air separator in accordance with claim 7 further comprising first telescoping cylinder means mounted on said first cover disk and second telescoping cylinder means mounted on said second cover disk, one of said first and second telescoping cylinder means being displaceable in the direction of the axis of rotation of the separator wheel with respect to the other of said first and second telescoping cylinder means, and the cover disk, blades, and first and second telescoping cylinder means being associated with one another such that the flow channels for the particles between the blades extend from the outer circumference of the separating wheel toward the separating air inlet and from the inner circumference of the separating wheel toward the fine particles outlet.

13. An air separator in accordance with claim 12 wherein the first and second telescoping cylinder means are mutually telescopically adjustable in relation to one another, the first telescoping cylinder means having a cylindrical wall extending from the first cover means toward the second cover means and the second telescoping cylinder means having a cylindrical wall extending from the second cover means toward the first cover means, one of said first and second telescoping cylinder means circumscribing the other of said first and second telescoping cylinder means.

14. An air separator in accordance with claim 12 wherein the separator wheel blades are fixedly connected to one of the first second telescoping cylinder means and the other of the first and second telescoping cylinder means has slots in its wall for enabling the blades to be slidably received therein, said blades and slots being closely dimensioned for forming a fluid tight seal therebetween.

15. An air separator in accordance with claim 12 wherein the first and second telescoping cylinder means form a fluid tight seal therebetween.

16. An air separator in accordance with claim 7 comprising means for guiding the material introduced into the separator wheel between the blades.

* * * * *